US007689153B2

(12) United States Patent
Nakagawa et al.

(10) Patent No.: US 7,689,153 B2
(45) Date of Patent: Mar. 30, 2010

(54) IMAGE FORMING SYSTEM HAVING CHARGE BALANCING SYSTEM

(75) Inventors: Tsutomu Nakagawa, Ibaraki (JP); Koji Kato, Ibaraki (JP); Tomonari Hokkyo, Ibaraki (JP); Kenji Nozawa, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 73 days.

(21) Appl. No.: 11/133,178

(22) Filed: May 20, 2005

(65) Prior Publication Data

US 2005/0271431 A1 Dec. 8, 2005

(30) Foreign Application Priority Data

May 21, 2004 (JP) ..... P2004-151893

(51) Int. Cl.
*G03G 15/22* (2006.01)
*G03G 15/20* (2006.01)
*G03G 15/00* (2006.01)

(52) U.S. Cl. ..... 399/306; 399/322; 399/400

(58) Field of Classification Search ..... 399/2, 399/6, 127, 128, 129, 306, 324, 322, 400, 399/3, 107

See application file for complete search history.

(56) References Cited

U.S. PATENT DOCUMENTS 4,579,446 A * 4/1986 Fujino et al. ..... 355/24
4,591,884 A * 5/1986 Miyamoto et al. ..... 347/153
5,121,285 A * 6/1992 McClure ..... 361/214
5,568,246 A * 10/1996 Keller et al. ..... 399/382
5,570,451 A * 10/1996 Sakaizawa et al. ..... 399/2
5,809,388 A * 9/1998 Inada et al. ..... 399/320
6,032,015 A * 2/2000 Umeda et al. ..... 399/306
6,484,009 B2 * 11/2002 Furuya et al. ..... 399/333
6,560,437 B2 * 5/2003 Kobaru et al. ..... 399/315
7,010,242 B2 * 3/2006 Suzuki et al. ..... 399/110
2004/0042820 A1 * 3/2004 Uchida et al. ..... 399/127

FOREIGN PATENT DOCUMENTS

JP 57062063 A * 4/1982
JP 57062066 A * 4/1982
JP 59-090874 5/1984
JP 60260978 A * 12/1985
JP 63118174 A * 5/1988
JP 01078261 A * 3/1989
JP 04034484 A * 2/1992
JP 04-321062 11/1992
JP 05053392 A * 3/1993
JP 09-311572 12/1997

(Continued)

OTHER PUBLICATIONS

Japanese Office Action dated Dec. 15, 2009 (with English translation).

*Primary Examiner*—Robert Beatty
(74) *Attorney, Agent, or Firm*—McGinn IP Law Group, PLLC

(57) ABSTRACT

An image formation system is configured by connecting two or more image formation devices. The system includes a fixing device fixing an unfixed development image to a record medium and a charge elimination device eliminating a charge of the record medium in an inlet of the fixing device of the second or later image formation device.

10 Claims, 2 Drawing Sheets

FOREIGN PATENT DOCUMENTS

| | | | |
|---|---|---|---|
| JP | 2000075735 A | * | 3/2000 |
| JP | 2002-091217 | | 3/2002 |
| JP | 2002162857 A | * | 6/2002 |
| JP | 2002244472 A | * | 8/2002 |
| JP | 2004-109175 | | 4/2004 |

* cited by examiner

IMAGE FORMING SYSTEM HAVING CHARGE BALANCING SYSTEM

BACKGROUND OF THE INVENTION

1. Field of the Invention

The present invention relates to an image formation system configured by connecting two or more image formation devices comprising a fixing device for fixing an unfixed development image to a record medium.

2. Description of the Related Art

In an image formation device using an electrophotographic method, a development image made of coloring particles formed on a photoconductor is transferred to a record medium such as paper and an unfixed development image adhering to the record medium is fixed to the record medium by a fixing device and thereby an image is obtained.

As a method for fixing an unfixed development image on a record medium, a fixing device called a thermal roller fixing method in which a heat source is had in the inside and a toner image is brought into direct contact with a heating roller made of metal material heated to a temperature enough to melt toner and simultaneously a pressure is applied by a pressurizing roller and fixing is performed by inserting a record medium between both the rollers is used.

In such an image formation device, a tandem type image formation system for disposing a joint path for transporting a record medium between plural image formation devices and forming an image is proposed.

In the tandem type image formation system, using coloring particles of different colors every each image formation device, images of plural colors can be formed, or an image of one side of the record medium can be formed by the first image formation device and an image of the back side of the record medium can be formed by the next image formation device.

In the tandem type image formation system, in a fixing process by image formation of only one side of the record medium, the record medium passes between both the rollers in a state in which the side to which a toner image is transferred makes contact with a heating roller in the first image formation device and the second image formation device and at this time, a slight amount of toner electrostatically adheres to a surface of the heating roller. Generally, in the heating roller, a cleaning web impregnated with silicone oil etc. is arranged so as to make sliding contact with the surface of the heating roller in order to ensure release characteristics of the heating roller and the toner on the record medium.

This cleaning web is non-woven fabric and makes sliding contact with the surface of the heating roller and thereby, silicone oil gradually seeps from the inside and the oil is applied to the heating roller and simultaneously by rubbing action, a slight amount of toner adhering to the surface of the heating roller is captured by the non-woven fabric and the cleaning web has action of cleaning the surface of the heating roller.

SUMMARY OF THE INVENTION

Many pressurizing rollers may have a fluorine resin layer such as PFA on a surface of the pressurizing roller in order to ensure release characteristics of the pressurizing roller and toner. Since an electrification series of the PFA is negative, the surface of the pressurizing roller is at a negative potential in many cases.

For example, after a toner image is formed on one side of a record medium by the first image formation device, paper is reversed and passes through a joint path and is introduced into the second image formation device. In the record medium transported to a transfer process of the second image formation device, the toner image formed on a surface of a photoconductor is transferred to the record medium. In the case of an image formation device using a reversal development method, toner is negatively charged. When the negatively charged toner is transferred to the record medium, a positive charge is injected into the back side of the record medium and a toner image is transferred. At this time, the toner image formed by the first image formation device is present on the back side of the record medium. The toner image on the back side of the record medium has a high probability of occurrence of toner having the positive charge because of the positive charge provided in the transfer process of the second image formation device.

The toner image present on the back side of the record medium is fixed by the first image formation device, but a situation in which the toner image is 100% fastened to the record medium does not occur generally. About several percent of toner of the toner image is in a state capable of adhering to the peripheral members in the case of applying slight force. When the record medium of such a state makes contact with a pressurizing roller of a fixing device of the second record medium, toner having small force of fastening to the record medium and having a positive charge of the back side of the record medium shifts to a surface of the pressurizing roller having a negative charge by electrostatic force.

Thus, slightly unfixed toner on a print surface among the toner image after fixing generated on one side of the record medium by at least the first image formation device makes direct contact with the pressurizing roller and as a result, the toner electrostatically shifts to the surface of the pressurizing roller and toner accumulation on a similar pressurizing roller may be caused. When the heating roller makes contact with the pressurizing roller and the rollers run idle at the time of restarting the image formation device, etc. and a temperature of the pressurizing roller exceeds the softening point of toner and its toner accumulation melts, its toner adheres to the side of contact between the transported record medium and the pressurizing roller, that is, the back side and the toner stains the record medium and serious error printing may be caused.

Particularly, in the case of a tandem type image formation system, it was proved that in an image formation device located in the downstream portion of an image formation device for forming an image upstream, the toner image creation side of a record medium in which the image is formed upstream makes contact with a surface of a pressurizing roller and the toner adheres to a surface of a pressurizing roller of the downstream image formation device in a manner similar to the principle described above. Also, when the toner adhering to the pressurizing roller is remarkably large at this time, the melting toner acts as an adhesive and a jam in which the record medium is wound on the side of the pressurizing roller may be caused.

In order to clean the toner adhering to the surface of the pressurizing roller, it is also considered that the toner is prevented from adhering by heating the surface of the pressurizing roller and setting a surface temperature of the pressurizing roller at the softening point or more of toner always, but adding a device for heating the surface of the pressurizing roller increases power consumption and also causes upsizing of the fixing device and it becomes a problem in design of the image formation device.

In order to recover the toner adhering to the surface of the pressurizing roller, it is also considered that extra toner is prevented from adhering to the record medium from the pressurizing roller by arranging a cleaner in the surface of the pressurizing roller and cleaning the pressurizing roller, but arranging the cleaner in the surface of the pressurizing roller causes upsizing of the device and also a temperature of the surface of the pressurizing roller is lower than a temperature of the heating roller, so that a problem that the toner of the surface of the pressurizing roller is fastened and all the toner cannot be recovered even in the case of attempting to recover the toner by the cleaner arises.

Therefore, it becomes necessary that the toner be not shifted from the record medium to the surface of the pressurizing roller wherever possible. A problem is to achieve a charge balance in which a toner image formed on a surface of a record medium does not shift to a pressurizing roller even in the case of making contact with the pressurizing roller.

According to one aspect of the invention, there is provided an image formation system configured by connecting two or more image formation devices, including: a fixing device fixing an unfixed development image to a record medium, and a charge elimination device eliminating a charge of the record medium in an inlet of the fixing device of the second or later image formation device.

By thus configuration, an image formation system in which a development image on a record medium does not adhere to a fixing roller and a good image without extra printing is obtained can be provided.

DESCRIPTION OF THE PREFERRED EMBODIMENTS

One embodiment of the invention will be described below with reference to the drawings.

Figure 1:
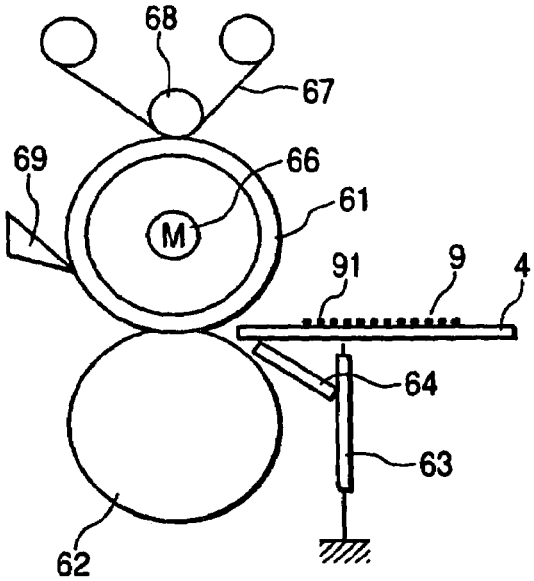
FIG. 1 is a schematic configuration diagram of a fixing device.

FIG. 1 is a schematic configuration diagram of a fixing device, and numeral 61 is a heating roller, and numeral 62 is a pressurizing roller, and numeral 63 is a charge elimination brush, and numeral 64 is an inlet paper guide plate, and numeral 66 is a heater lamp, and numeral 67 is a cleaning web, and numeral 68 is a pressure contact roller, and numeral 69 is a paper peel claw, and numeral 9 is toner, and numeral 91 is a development image, and numeral 4 is a record medium.

Figure 2:
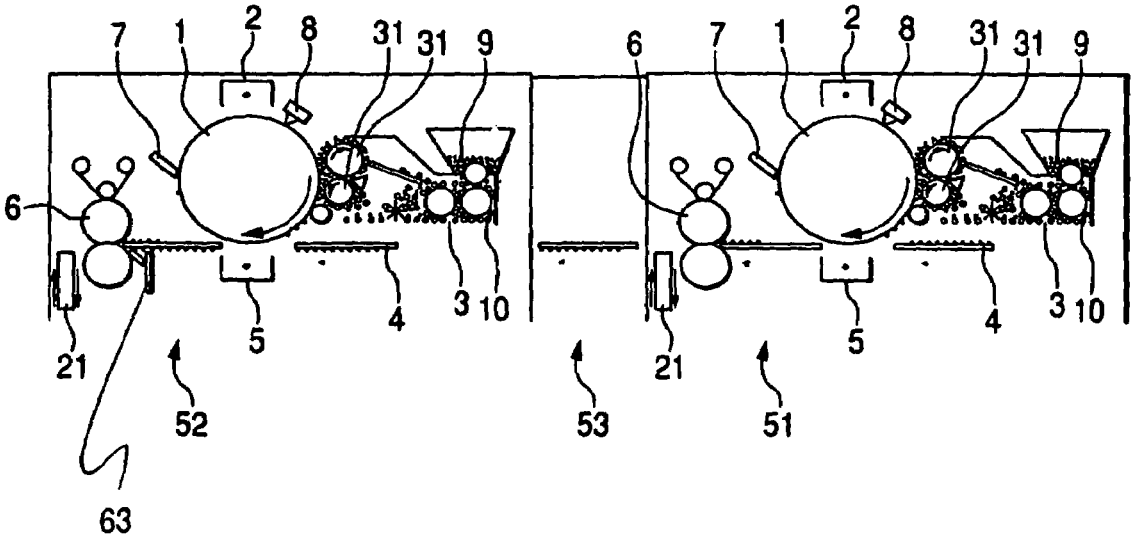
FIG. 2 is a schematic configuration diagram of an image formation system.

FIG. 2 is one example of an image formation system, and numeral 1 is a photoconductor drum, and numeral 2 is an electrification device, and numeral 3 is a developing device, and numeral 31 is a developing roller, and numeral 4 is a record medium, and numeral 5 is a transfer device, and numeral 6 is a fixing device, and numeral 7 is a cleaner, and numeral 8 is an exposure device, and numeral 9 is toner, and numeral 10 is a carrier, and numeral 21 is a paper reversal device, and numeral 51 is a first image formation device (hereinafter also called "a first engine"), and numeral 52 is a second image formation device (hereinafter also called "a second engine"), and numeral 53 is a joint path.

A tandem type image formation system shown in the present embodiment has a structure of joining the first engine 51 to the second engine 52 by the joint path 53, and devices used in an electrophotographic method of a similar structure are arranged in both of the first engine 51 and the second engine 52.

FIG. 2 also shows exemplarily the charge elimination brush 63 at the inlet of the fixing device 6 of the second engine 52. A corresponding charge provisioning device, such as a corotron 73, is shown in the inlet of the fixing device 6 of the second engine 52 in FIG. 3.

First, an electrostatic latent image by disappearance of a charge through the exposure device 8 according to image information is formed on a surface of the photoconductor drum 1 electrified to a negative potential uniformly by the electrification device 2 inside the first engine 51 shown in FIG. 2. Thereafter, the toner 9 electrified to a negative charge is supplied from the developing roller 31 of the developing device 3 and a toner image 91 which is a visualized image is formed according to the electrostatic latent image. The toner 9 having the negative charge on the surface of the photoconductor drum 1 developed thus is transferred on the record medium 4 by a positive charge supplied from the transfer device 5.

The transferred toner 9 is inserted into a portion of contact between the pressurizing roller 62 and the heating roller 61 in which a surface of the roller is controlled at a predetermined temperature by the heater lamp 66 inside the fixing device 6, and penetrates to the front side of the record medium 4 by pressure as well as heating melting by heat energy and thereafter, is fastened and fixed on the record medium 4. However, a situation in which the toner 9 on the record medium 4 is 100% fixed does not occur, and several percent of the toner 9 is in a state movable by external force or electrostatic force of the periphery.

The record medium 4 passing through the fixing device 6 is reversed by the reversal device 21 and passes through the joint path 53. After passing through the joint path 53, the record medium 4 is introduced into the second engine 52. In the record medium 4 introduced into the second engine 52, an electrostatic latent image by disappearance of a charge through the exposure device 8 according to image information is formed on a surface of the photoconductor drum 1 electrified to a negative potential uniformly by the electrification device 2 inside the second engine 52. Thereafter, the toner 9 electrified to a negative charge is supplied from the developing roller 31 of the developing device 3 and a toner image 91 which is a visualized image is formed according to the electrostatic latent image.

The toner 9 having the negative charge on the surface of the photoconductor drum 1 developed thus is transferred on the record medium 4 by a positive charge supplied from the transfer device 5. In the case of the transfer, the quantity of positive charge best suitable to transfer the toner image 91 developed on the photoconductor drum 1 to the record medium 4 is supplied to the transfer device 5. In that case, the toner image 91 formed by the first engine is present on the back side of the record medium 4 and an excessive positive charge is injected into the toner image 91 of the back side of the record medium 4. Because of the influence, the toner image 91 present on the back side of the record medium 4 results in the toner image 91 electrified to the positive charge.

The record medium 4 passing through the transfer device 5 makes contact with the charge elimination brush 63 arranged in the front of the inlet paper guide plate 64 of the fixing device 6. As a result of this, the charge of the toner image 91 present on the back side of the record medium 4 is eliminated and each of the particles of the toner 9 changes to a zero potential. Thereafter, the record medium 4 is introduced into the inlet paper guide plate 64 and reaches a portion of contact between the pressurizing roller 62 and the heating roller 61 heated. A fluorine resin layer is arranged on surfaces of the pressurizing roller 62 and the heating roller 61 in order to ensure release characteristics to the toner. The heating roller 61 and the pressurizing roller 62 contact and rotate with the rollers mutually pressed and contacted. An electrification series of the resin layer is negative and the resin layer is maintained at a negative potential of several kV always.

Therefore, adsorption is performed when there is an object having a positive charge in the periphery. The toner image 91 on the back side of the record medium 4 reaching the portion of contact between the heating roller 61 and the pressurizing roller 62 is at a zero potential at this time and in the case of making contact with the pressurizing roller 62, the toner image 91 does not shift to a surface of the pressurizing roller 62 and stays on the back side of the record medium 4. In the portion of contact between the heating roller 61 and the pressurizing roller 62, in a manner similar to the first engine 51, the toner 9 on the front side of the record medium 4 penetrates to the front side of the record medium 4 by pressure as well as heating melting by heat energy and thereafter, is fastened and fixed on the record medium 4. The image formation is completed in the process described above.

According to the embodiment described above, a positive charge of the toner 9 adhering to the back side of the record medium 4 is eliminated and the toner 9 having the positive charge can be prevented from being adsorbed to a surface of the pressurizing roller 62 having a negative charge, and there is an effect of preventing unnecessary toner 9 from adhering to the surface of the pressurizing roller 62.

Incidentally, in the embodiment, the charge elimination brush 63 has been used in an inlet of the fixing device 6, but an effect similar to that obtained in this embodiment is obtained when the charge of the toner image 91 on the back side of the record medium 4 can be eliminated in the front of the heating roller 61 and the pressurizing roller 62. Therefore, a similar effect can naturally be obtained when an inlet guide of the fixing device 6 of the second engine 52 is installed at a ground level, using, for example, a charge elimination brush 63, and time and length of contact with the toner image 91 on the back side of the record medium 4 are sufficiently ensured and charge elimination of the toner image 91 on the back side of the record medium 4 is achieved.

Figure 3:
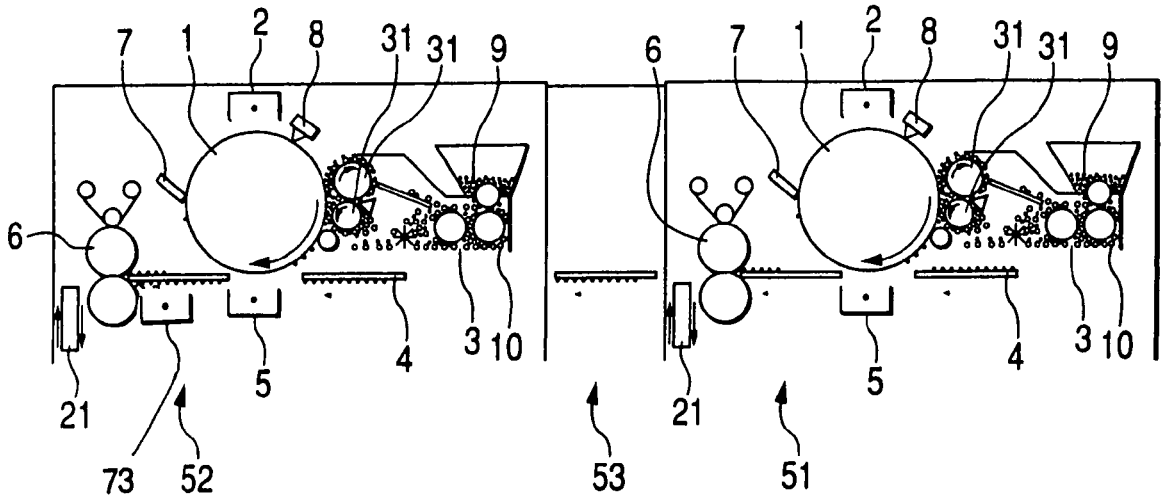
FIG. 3 exemplarily shows an alternate configuration having a corotron 73 at the inlet of the second engine.

Also, an effect becomes larger when the toner 9 on the back side of the record medium 4 has a negative charge so that the toner 9 on the back side of the record medium 4 is not adsorbed to the pressurizing roller 62 having a negative charge on the surface. Therefore, a larger effect can be obtained when an inlet of the fixing device 6 is provided with a corotron capable of providing a charge for the back side of the record medium 4 and a negative charge is provided for the toner 9 on the back side of the record medium 4, similar to corotron 73 exemplarily shown in the inlet of the fixing device 6 of the second engine 52, as shown in FIG. 3.

Further, in order that the toner 9 is not adsorbed to a surface of the pressurizing roller 62, the surface of the pressurizing roller 62 could be set at a zero potential or be controlled to polarity opposite to polarity of the charge which the toner 9 has, so that an effect similar to that of the embodiment can also be obtained by controlling a potential of the surface of the pressurizing roller 62 by the corotron or the charge elimination brush, etc.

In the embodiment, a phenomenon in the second engine 52 of the tandem type image formation system has been described, but when image formation devices such as a third engine or a fourth engine are further connected, action and effect similar to those of the embodiment can also be obtained in fixing devices of each of the image formation devices.

What is claimed is:

1. An image formation system formed by connecting two or more image formation devices, the image formation system comprising:

a first image formation device to fix an image on a first surface of a record medium; and a second image formation device substantially immediately subsequent to said first image formation device, said second image formation device receiving the record medium from said first image formation device, thereby being a downstream image formation device of said first image formation device, wherein said second image formation device comprises:

a fixing device that fixes an unfixed development image to an opposite, second surface of said record medium; and a charge elimination device that eliminates a charge of the record medium in an inlet of the fixing device, as resultant from an image fixed by said first image formation device on said first surface of said record medium, said charge elimination device being incorporated only in said second image formation device.

2. An image formation system according to claim 1, wherein the charge elimination device comprises a brush.

3. An image formation system according to claim 1, wherein the first and second image formation devices are connected by a joint path.

4. An image formation system according to claim 1, wherein the first and second image formation devices further comprise a paper reversal device.

5. An image formation system according to claim 1, wherein said first image formation device forms an image on a front side of the record medium and said second image formation device forms an image on a back side of the record medium.

6. An image formation system according to claim 1, further comprising a pressure roller, wherein the pressure roller comprises a zero electrical potential.

7. An image formation system according to claim 1, wherein the fixing device further comprises a pressure roller, wherein the pressure roller has a polarity opposite to a polarity of charge of toner.

8. An image formation system according to claim 5, wherein the charge elimination device eliminates a charge of toner particles present on the back side of the record medium.

9. An image formation system formed by connecting two or more image formation devices, the image formation system comprising:

a first image formation device that fixes a first unfixed development image to a first surface of a record medium; and a second image formation device substantially immediately subsequent to said first image formation device, said second image formation device receiving said record medium from said first image formation device, thereby being a downstream image formation device of said first image formation device, wherein said second image formation device comprises:

a fixing device that fixes an unfixed development image to a second surface of said received record medium; and a charge provision device that provides a charge for the record medium in an inlet of the fixing device, thereby neutralizing a residual charge on the record medium as resultant from the image on the first surface fixed by said first image formation device, said charge provision device being incorporated only in said second image formation device.

10. An image formation system according to claim 9, wherein the charge provision device comprises a corotron.

* * * * *